United States Patent [19]

Lehnert

[11] 4,142,096

[45] Feb. 27, 1979

[54] EVENTS ACCUMULATOR DEVICE AND METHOD

[76] Inventor: Daryl A. Lehnert, 2211 Merriam La., Kansas City, Kans. 66106

[21] Appl. No.: 850,696

[22] Filed: Nov. 11, 1977

[51] Int. Cl.[2] ..... G06M 1/272

[52] U.S. Cl. ..... 235/92 EA; 235/92 MT; 235/92 V; 235/92 R; 250/570; 235/92 AC

[58] Field of Search ..... 235/92 MT, 92 EL, 92 EA, 235/92 V, 92 C, 92 AC, 92 CA, 92 FP, 136, 139 R, 139 A; 250/570

[56] References Cited

U.S. PATENT DOCUMENTS

| | | | |
|---|---|---|---|
| 3,275,807 | 9/1966 | Harper | 235/92 C |
| 3,278,725 | 10/1966 | Gunst | 235/92 C |
| 3,286,714 | 8/1966 | Wales | 235/92 C |
| 3,399,297 | 8/1968 | Miller | 235/92 CV |
| 3,752,965 | 8/1973 | Haydon | 235/136 |
| 3,914,583 | 10/1975 | Einem et al. | 235/92 C |
| 4,031,386 | 6/1977 | Recker | 235/92 EA |

*Primary Examiner*—Joseph M. Thesz

*Attorney, Agent, or Firm*—Lowe, Kokjer, Kircher, Wharton & Bowman

[57] ABSTRACT

A device which mechanically records, accumulates and stores events such as the consumption of water, gas or electricity, and which, on command, transmits the stored information in serial, digitized form. A series of optically coded storage wheels representing respective decimal columns are driven by a water meter or the like and are geared together such that each adjacent pair of wheels rotates in a one to ten ratio. Each wheel includes a set of binary coded discs which may be optically scanned to provide data as to the instantaneous position of the wheel and thus the cumulative total of the usage of water. The scanning operation is performed by a diode and photocell assembly which is serially scanned past the wheels in a manner such that a light beam is interrupted in a pattern conforming with the rotative positions of the storage wheels. The photocell senses the light interruption pattern and transmits a pulsed signal that contains the desired information.

4 Claims, 7 Drawing Figures

10
11
11a
11b
11c
11d
11e
12
13
14
16
16a
16b
16c
16d
16e
16f
17
18
19
20
22
23
24
25
26a
26b
26c
26d
26e
26f
27
27a
28
29
30
31
32
33
34
35
36
38
39
40
41
42
43
44
45
46
48
49
49a
49b
50
52
53
54
55
56
57
58
59
60
61
2.
3.
4.

16
17
18
19

11a
11c
28
40
41
42
43
48
49
50
52
53
54
55
56
57

11b
11c
12
26f
27
31
31a
32a
34a
36
38
44
44a
45
46

EVENTS ACCUMULATOR DEVICE AND METHOD

BACKGROUND AND SUMMARY OF THE INVENTION

This invention relates generally to the recording and accumulation of events such as the amount of electricity, gas, or water used. More particularly, the invention deals with an improved method and device for recording, storing, and retrieving information of this nature.

In the past it has been the common practice for electric meters, gas meters, water meters and the like to be visually inspected, and manually recorded by a meter reader. Manifestly, this procedure requires a large number of man hours with the attendant labor costs and potential for human error. Moreover, the meters can be read only infrequently due to practical considerations and time limitations.

The present invention is directed to overcoming these difficulties by providing a device that mechanically records, accumulates, and stores information as to the occurrence of events such as the usage of water, gas or electricity. The device may be easily coupled to the rotor of an existing meter, and it includes a series of storage wheels each having a set of binary coded discs which rotate in correspondence with the movement of the rotor. The discs are arranged in each storage wheel such that their rotative position provides an optically detectable indication of the total number of events that have occurred. The discs may be optically scanned in order to transmit, in serial digitized form, the information that is stored on the wheels.

It is the primary object of this invention to provide a method and device for accurately recording, accumulating, storing, and transmitting information concerning events such as consumption of electricity, water, gas and the like.

Another object of the invention is to provide a method and device of the character described which requires only a minimum amount of power and which retains the stored data in the event of a power failure. Since the input to the device comes directly from the meter, the only power needed is the small amount required to operate the optical scanning mechanism at infrequent intervals. Moreover, the information is stored mechanically according to the positions of the binary coded discs so that the stored information is retained even if the power should fail.

Still another object of the invention is to provide a device of the character described which transmits accurate output data in serial, digitized form. The accumulated information is stored mechanically in parallel form on the binary coded discs, and it is retrieved in serial form by scanning the discs one after the other to provide a digital output.

A further object of the invention is to provide a method and device of the character described wherein the scanning operation is performed in two half cycles which are reversed with respect to one another and which are compared to verify the accuracy of the data that is obtained.

An additional object of the invention is to provide, in a device of the character described, a unique gearing arrangement which rotates successive storage wheels in the proper one to ten ratio while minimizing the time required for each wheel to shift from one digit to the next.

Yet another object of the invention is to provide, in a device of the character described, an identification code which may be programmed in the field and which may be easily replaced.

Still another object of the invention is to provide a device of the character described which is more secure than existing devices. The device and the rotor that drives it can be encased in a secure enclosure which may be located in an out-of-the-way area where tampering cannot occur.

A still further object of the invention is to provide a device of the character described which is simple and economical to construct and operate, which may be quickly and easily installed, and which is suitable for use with a wide variety of meters and other equipment.

Other and further objects of the invention, together with the features of novelty appurtenant thereto, will appear in the course of the following description of the drawings.

DETAILED DESCRIPTION OF THE INVENTION

In the accompanying drawings which form a part of the specification and are to be read in conjunction therewith, and in which like reference numerals are employed to indicate like parts in the various views.

Figure 1:
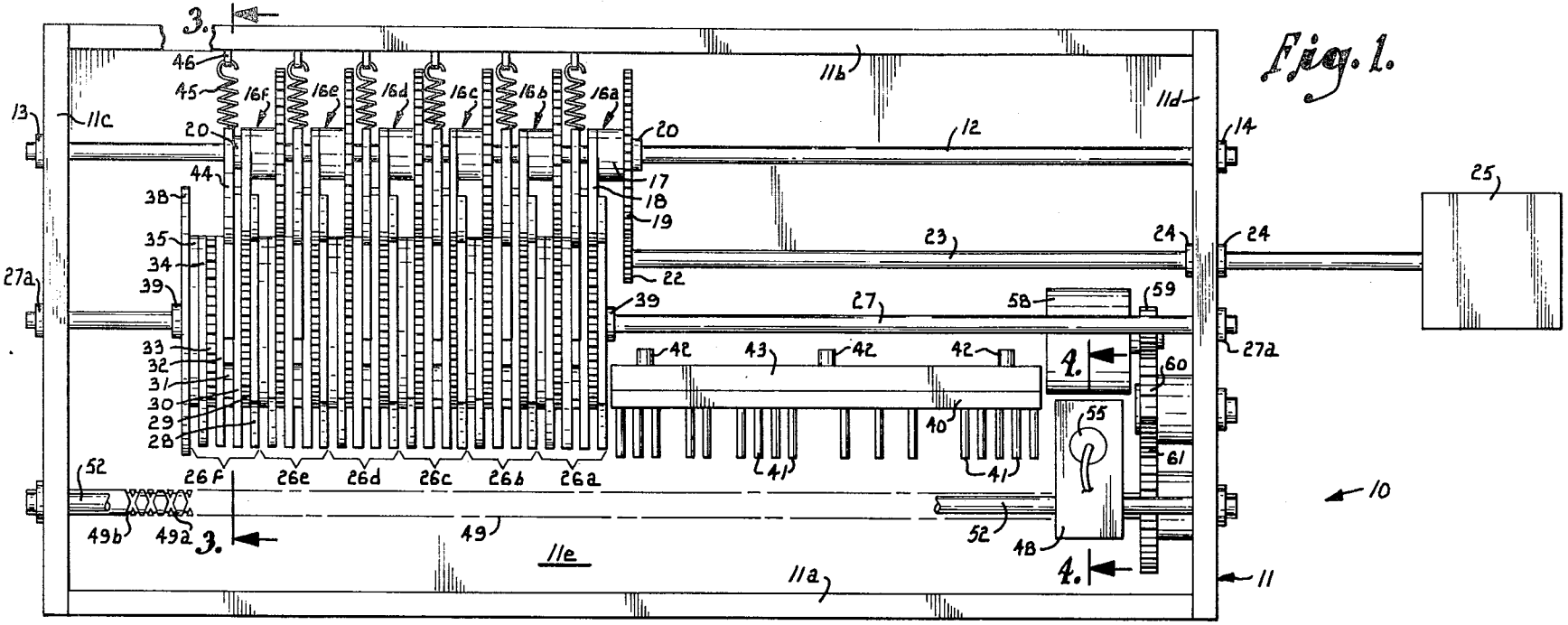
FIG. 1 is a top plan view of an accumulator device constructed in accordance with a preferred embodiment of the invention.

Referring now to the drawings in more detail and initially to FIG. 1 in particular, reference numeral 10 generally designates the accumulator device of the present invention. The device has a frame 11 which includes opposite sides **11*a* and 11*b*, opposite end plates 11*c* and 11*d*, and a flat floor panel 11*e*, all of which are rigidly interconnected. A horizontal shaft 12 is mounted on the frame in extension between the end plates 11*c* and 11*d*. Collars 13 and 14 prevent axial sliding of shaft 12** on the frame.

Figure 5:
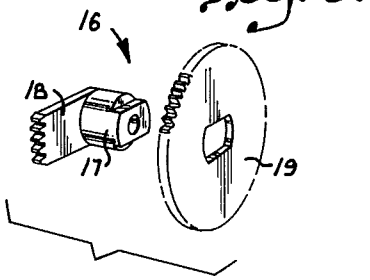
FIG. 5 is an exploded perspective view of one of the gear assemblies included in the accumulator device.

Six gear assemblies **16*a*–16*f* are mounted for rotation on shaft 12. With particular reference to FIG. 5, each of the gear assemblies is identical, having a cylindrical hub 17 which fits rotatably on shaft 12 and which rigidly carries a small gear 18 at one end. Gear 18 is in the shape of a small segment of a wheel and has a peripheral edge in the form of a toothed arc. A large circular wheel 19 is pressed onto the opposite end of each hub 17 and is rigid therewith. The ratio of the number of teeth on gear 18 to the number of teeth on gear 19 is one to ten, with gear 18 having four teeth and gear 19** having forty teeth in the preferred form of the invention.

Referring again to FIG. 1, the gear assemblies 16a–16f are arranged successively in a series on shaft 12 and are spaced apart slightly from one another. Collars 20 prevent the gear assemblies from sliding axially on shaft 12, although they are able to rotate thereon as previously indicated.

The large gear 19 of the initial gear assembly 16a is driven by a gear 22 carried on a horizontal shaft 23. The shaft 23 is supported for rotation on frame 11 by bearings 24, and the shaft is driven by a rotor 25 which may be the rotor of a conventional meter such as a natural gas meter, a water meter, an electric meter, or a similar device (not shown).

The gear assemblies 16a–16f mate with a series of binary coded storage wheels 26a–26f which represent consecutive columns in the decimal number system. Each wheel is mounted for rotation on a horizontal shaft 27 extending between end plates 11c and 11d. Shaft 27 is at the same elevation as shaft 12 and is located to one side thereof. Collars 27a prevent axial sliding of shaft 27. The storage wheels 26a–26f are constructed identically, and each is provided with a set of four binary coded discs.

Figure 6:
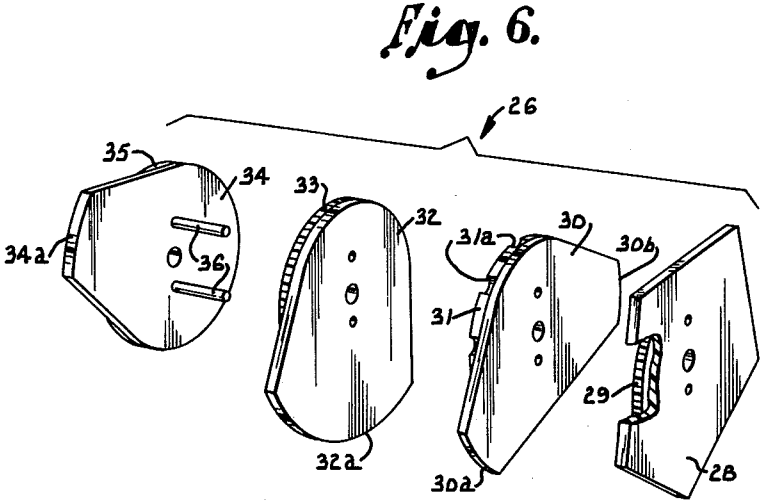
FIG. 6 is an exploded perspective of one of the binary coded storage wheels included in the accumulator device.

With reference now to FIG. 6 in particular, each storage wheel has at one end a pentagon shaped binary coded disc 28 which corresponds with the binary "ones" place on the wheel. A circular gear 29 having the same size as gear 19 and forty teeth is rigid with one side of disc 28. Binary coded disc 30 corresponds with the binary "twos" place on the wheel and has a pair of outwardly and downwardly projecting wing portions 30a and 30b. A circular wheel 31 having a plurality of peripheral notches 31a is mounted rigidly against one side of disc 30. The binary "fours" place of each wheel is occupied by a binary coded disc 32 having a downwardly projecting fan portion 32a and a circular gear 33 mounted to one of its sides. Gear 33 is the same size as gear 19 and is provided with forty peripheral teeth. The binary "eights" place of each wheel is occupied by a binary coded disc 34 having a single projecting wing 34a. A spacing wheel 35 is carried on one side of disc 34.

Each storage wheel is assembled in the manner best illustrated in FIG. 6. Disc 34 has a pair of pins 36 which extend through holes formed in each of the discs 28, 30 and 32 and their associated components. Each storage wheel is thus a rigid assembly of four binary coded discs which are spaced slightly apart from one another.

The manner in which the discs of each storage wheel are binary coded should be evident. The presence of a projection outwardly from a particular location on each disc indicates that the disc is in the binary one position, while the absence of an outward projection represents the binary zero position of the disc. As viewed in FIG. 6, the binary number zero is displayed at the top of the wheel assembly since there are no upward projections from any of the binary coded discs. The binary number one is displayed in the position located one tenth of a revolution clockwise from the top, since only disc 28 projects outwardly beyond the circular center portion on that part of the wheel. The binary number 10 is displayed at a position located another one tenth of a revolution clockwise, due to the presence of only the wing 30b of disc 30. Similarly, the binary numbers 11, 100, 101, 110, 111, 1000, and 1001 are displayed consecutively at additional incremental positions around the wheel due to the configurations of the binary coded discs. It is thus apparent that each storage wheel is constructed to represent a column in the decimal number system because the wheel displays each decimal digit on its periphery, with the particular decimal digit displayed on the rotative position of the wheel with respect to a reference position.

Referring again to FIG. 1, the storage wheels 26a–26f are arranged adjacent to one another in a series on shaft 27, with the spacing disc 35 of each wheel abutting the initial binary coded disc 28 of the next wheel. Wheels 26a–26f represent respectively the decimal places for units, tens, hundreds, thousands, ten thousands, and hundred thousands. A large solid circular disc 38 is mounted on shaft 27 at a location adjacent to the end of wheel 26f. A pair of collars 39 prevent the storage wheels from sliding axially on shaft 27, although allowing them to rotate thereon.

The small gears 18 of the respective gear assemblies drive the initial gears 29 of the storage wheels, while each storage wheel in turn drives, through its gear 33, the large gear 19 of the next gear assembly. For example, gear 18 of gear assembly 16a mates with and drives gear 29 of wheel 26a, while gear 33 of wheel 26a mates with and drives gear 19 of gear assembly 16b. Since gear 18 has only one tenth as many teeth as gear 29, each revolution of gear assembly 16a rotates wheel 26a only one tenth of a revolution. For each revolution of wheel 26a, gear assembly 16b is driven in complete revolution; however, its small gear 18 drives wheel 26b through only one tenth of a revolution. Each time wheel 26a moves from the decimal digit 9 to 0, wheel 26b moves up one decimal digit, such as from zero to one for example.

The same ten to one gearing relationship is provided between each adjacent pair of storage wheels, and it is thus apparent that the gearing arrangement causes each storage wheel to rotate only one tenth as far as the preceding wheel. The proper relative motion of wheels 26a–26f is thereby obtained enabling them to accurately represent consecutive decimal places. It is pointed out that the change of each wheel from one digit to the next occurs rapidly since it is effected during the short time that the small gear 18 is engaged with gear 29.

The device is provided with an identification code in the form of an elongate strip 40 from which a plurality of uniformly spaced pins 41 project. Pins 41 are at the same elevation as shaft 27. Strip 40 has projecting mounting pegs 42 which may be extended through holes in a mounting block 43 secured to the floor panel 11e of the frame. Each strip 40 may thus be easily removed and replaced by another identification strip having a different code pattern. The pins 41 serve as identification bits which may be broken off in accordance with the particular identification code assigned to the unit, so that the programming may be carried out in the field. The outer tips of pins 41 are located in line with the peripheral side edges of the storage wheels, as best shown in FIG. 4.

Figure 3:
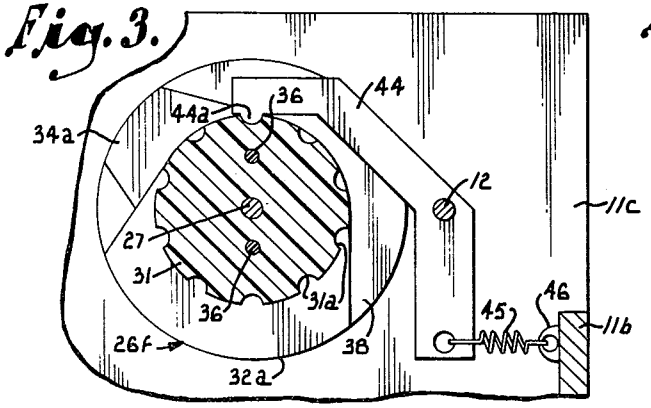
FIG. 3 is a fragmentary sectional view taken generally along line 3—3 of FIG. 1 in the direction of the arrows.

Each storage wheel has a pawl 44 which acts to maintain the wheel in place unless the wheel is positively rotated. With particular reference to FIG. 3, each pawl 44 is in the form of a bent arm pivotally mounted on shaft 12 at a location between adjacent gear assemblies. A tension spring 45 is hooked to the lower end of each pawl and to an eye 46 projecting from the frame side 11b. The upper end of each pawl is provided with a downwardly projecting detent 44a which is sized to fit closely in the notches 31a of the corresponding wheel 31. The biasing action of spring 45 maintains detent 44a in one of the notches 38 and thereby prevents the storage wheel from rotating inadvertently. However, when the wheel is positively rotated, the spring yields to permit advancement of the wheel.

An optical scanning mechanism is employed to optically read the instantaneous positions of the storage wheels 26a–26f. With reference to FIGS. 1 and 4, a block 48 is mounted on a horizontal shaft 49 which is supported for rotation in extension between frame plates 11c and 11d. Shaft 49 is located at the same elevation as pins 41 and slightly beyond the tips thereof, as best shown in FIG. 4. Referring to FIG. 1, shaft 49 is reversely threaded, having grooves 49a and 49b which spiral around the shaft in opposite directions. The shaft extends through an opening in block 48, and a set screw 50 (FIG. 4) is threaded into the block with its tip located in one of the grooves 49a or 49b. Accordingly, rotation of shaft 49 advances block 48 back and forth along the shaft due to the cooperation of set screw 50 and the spiral grooves 49a and 49b.

Figure 4:
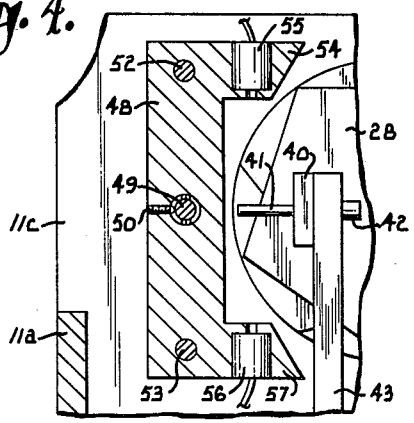
FIG. 4 is a fragmentary sectional view taken generally along line 4—4 of FIG. 1 in the direction of the arrows.

Upper and lower guide shafts 52 and 53 extend between plates 11c and 11d and through the upper and lower portions of block 48, as shown in FIG. 4. Shafts 52 and 53 serve to maintain block 48 in the proper orientation as it travels back and forth along shaft 49.

With continued reference to FIG. 4, block 48 has an overhanging upper flange 54 which carries a light source such as a light emitting diode 55. The diode emits a beam of light which is directed downwardly toward a photocell 56 carried on a lower flange 57 of the block. The light beam from diode 55 reaches the photocell 56 unless an obstruction is located therebetween, in which case the photocell senses the interruption of the beam and provides a pulsed output signal in the usual manner.

Figure 2:
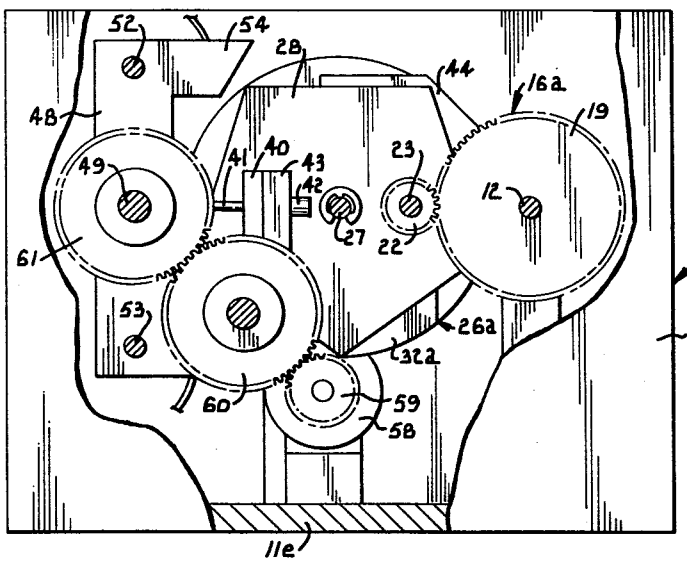
FIG. 2 is an end elevational view of the accumulator device taken from the right hand side of FIG. 1, with a portion of the frame broken away for illustrative purposes.

Shaft 49 is driven rotatively by a small DC motor 58 having an output shaft which carries a gear 59. As best shown in FIG. 2, gear 59 mates with an intermediate gear 60 which in turn drives a gear 61 mounted on shaft 49. The speed of rotation of shaft 49 (and thus the speed of travel of block 48) may be varied by varying the gear ratio between motor 58 and shaft 49.

Figure 7:
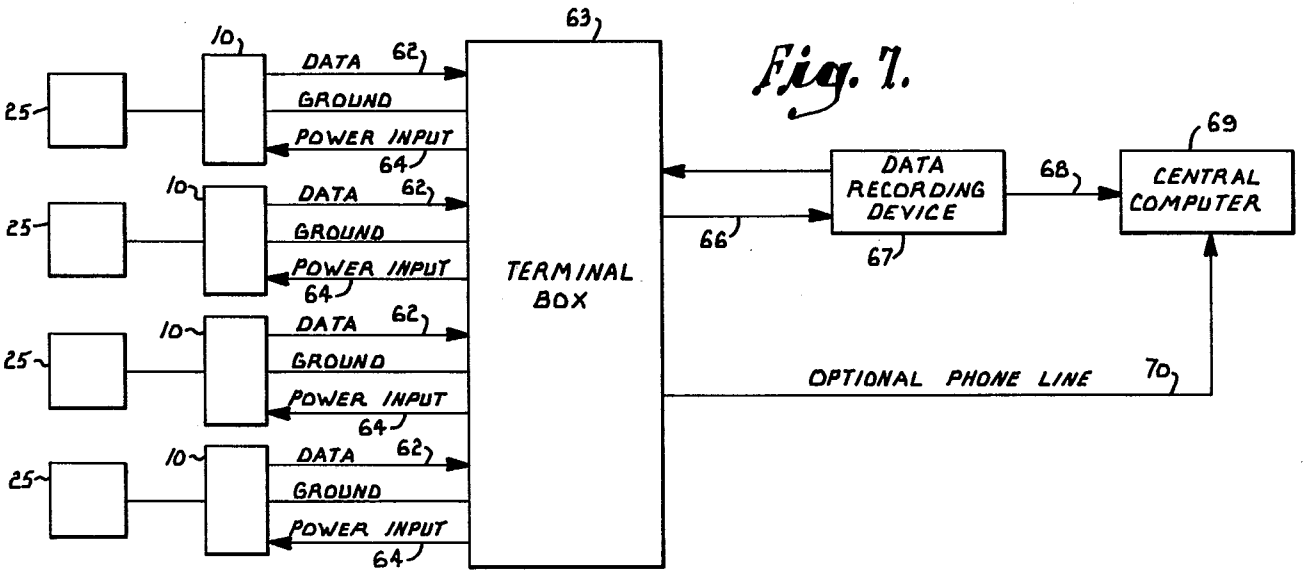
FIG. 7 is a block diagram showing schematically a data collection and processing system incorporating the accumulator device of the present invention.

Referring now to FIG. 7, the data obtained from the binary coded discs of the storage wheels is transmitted along a transmission line 62 that leads to a terminal box 63 which is conveniently located to provide ready access to the lines of each unit 10. A power input line 64 extends from the terminal box 63 to each accumulator device 10 in order to supply power for operating diode 55 and motor 58. The data from each unit 10 may be transmitted from the terminal box 63 via a plug-in line 66 to a data recording device 67 which is preferably a portable device containing the necessary electronics to scan the optical reader, check the data, and provide a record of the output data on magnetic tape, punch cards, or the like. The recorded data may be transmitted along line 68 to a central computer 69 for further processing. Alternatively, the portable data recording device 67 may be carried to the central computer 69 to which device 67 feeds the stored data obtained from a large number of units 10. The data from box 63 may instead be transmitted directly to the computer via an optional phone line 70.

In operation, the storage wheels 26a–26f are initially set in a reference position wherein each bit of each wheel reads zero along the path of travel of the optical scanning mechanism. As rotor 25 turns in response to the usage of gas, water, or electricity, gear assembly 16a is turned in direct proportion due to its geared connection with the rotor. Preferably, the gearing is such that gear assembly 16a is rotated once for each unit of energy or water consumed, because the unit wheel 26a will then be rotated one tenth of a revolution for each unit that is consumed. When wheel 26a has been rotated a complete revolution, wheel 26b advances one tenth of a revolution to indicate that ten units have been consumed. In like fashion, the remaining storage wheels turn in correspondence with the amount of energy or water used, and a record of the total quantity that has been used is mechanically stored in parallel form on the wheels. This recorded information may be retrieved by detecting the rotative position of each wheel with respect to the zero reference position.

The information stored on the wheels is read by the optical scanner. To initiate the scanning operation, motor 58 is energized to rotate shaft 49 and thus drive block 48 from right to left at a constant speed along the shaft from the rest position shown in FIG. 1. The light emitting diode 55 is energized, and its light beam will be interrupted by the first or right most pin 41 which serves as a "start" pin that provides an initial pulse indicating that the transmission of useful data is about to begin. As block 48 continues to move to the left at a constant speed, the light beam is interrupted by the pins 41 which have not been broken away. The pattern of interruption of the beam is sensed by the photocell 56 and transmitted on line 62 in the form of a synchronized pulsed output signal, with the pulses occurring each time the light beam is interrupted. When the last pin 41 has been passed, complete numerical information as to the identity of the unit will have been transmitted in binary form, as determined by the coded pattern of pins 41.

After the identification data, the next data bits encountered by the scanner provide information as to the number of units of energy or water that have been consumed. For example, when the first disc 28 of the units wheel 26a is reached, it will be in a rotative position to either block the light beam or permit it to reach photocell 56. In the former case, the photocell senses a binary 1 (pulse), while in the latter case a binary zero (no pulse) is sensed. Similarly, the other binary coded discs 30, 32 and 34 of wheel 26a will be optically detected as being in the binary one or binary zero position, depending upon whether they are in position to intercept or not intercept the light beam which is directed downwardly along the periphery of the wheel. As an example, assume that discs 28 and 32 of wheel 26a block the beam and that discs 30 and 34 do not. The binary number 0101 is thus sensed by photocell 56, indicating that wheel 26a is in the position corresponding to the decimal number 5.

The scanner next encounters the tens wheel 26b and scans its four binary coded discs in series to detect, by the pattern of interruption of the light that reaches the photocell 56, the position of the wheel and thus the number of tens of units of energy or water that have been used. The succeeding storage wheels are likewise scanned optically in series to provide information with regard to their positions, which correspond respectively to the number of hundreds, thousands, ten thousands, and hundred thousands of units of energy or water that have been consumed.

When block 48 reaches the left end of shaft 49, complete information as to the rotative position of each storage wheel 26a–26f will have been transmitted to the data collection device 63. The scanning mechanism then leaves groove 49a and enters groove 49b to reverse direction and begin travelling to the right on shaft 49 due to the reverse orientation of groove 49b. When the large disc 38 is encountered, it intercepts the light beam to provide a "start" pulse for the second scanning half cycle. As the storage wheels are thereafter scanned serially from left to right, information as to their rotative positions is transmitted, with the data being reversed in order as compared to the initial scanning operation which was carried out from right to left.

The data obtained from the two scanning passes are compared by a conventional comparator device 67 to verify that they are in correspondence. If not, a fault condition exists and the recording device automatically issues a reread command causing a repeat of the scanning cycle. For example, if one of the storage wheels is in the process of changing from one digit to another when encountered by the optical scanner, the data obtained from the scanning in one direction may not agree with that obtained in the other direction. Consequently, a reread command is automatically issued to effect a repeat of the scanning operation until consistent data are obtained. It is very unlikely that any one of the storage wheels will be in the process of changing digits when scanned in both directions, due to the rapid change achieved by the gearing arrangement. Nevertheless, to assure that such will not occur, it may be desirable to provide a delay between the first half of the scanning cycle and the second half. A weighted gearing system can be provided between rotor 25 and gear assembly 16 to make the change time independent of rotor speed.

It is pointed out that during the first half of the scanning cycle, or the period of scanning from right to left, the data are transmitted with the least significant bit of each storage wheel first and the most significant bit last, and with the least significant digit first and the most significant digit last. The last half of the read cycle transmits the most significant data bits and digits first and the least significant bits and digits last. The information obtained from the two half cycles is compared to check the accuracy of the read operation and to eliminate the possibility of obtaining faulty data.

Although six storage wheels are illustrated, it should be evident that any number may be included in the device. Further, the accumulator device 10 may be coupled with any type of meter or other device which operates in accordance with the occurrence of the events that are to be recorded and accumulated. Even if a power failure precludes carrying out the scanning cycle, the information mechanically stored on the wheels will not be lost since the wheels remain in their rotative positions regardless of whether or not external power is available. They continue to rotate in accordance with the occurrence of the events measured. Binary coded discs constructed in a manner different than those illustrated are contemplated by the invention, as are scanning mechanisms of various types.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A device for recording and accumulating events, said device comprising:

a frame;

a plurality of wheel members each mounted for rotation on said frame, one of said wheel members being adapted to be drivingly rotated in relation to the occurrence of the events that are to be recorded and accumulated;

optically coded means on each of said wheel members for indicating the rotative position of the wheel member with respect to a reference position;

means coupling said wheel members together for differential rotation, with the rotation of each wheel member being related to the rotation of said one member in a predetermined ratio;

a light source operable to emit a beam of light;

a light sensor spaced from said light source in the path of said beam; and means for scanning said light source along a preselected path, each wheel member being located generally along said path and being optically coded in a manner to intercept the light beam in accordance with the rotative position of the wheel member as said source is scanned along said path, whereby the pattern of light reaching said sensor corresponds with the rotative positions of said wheel members.

2. A device as set forth in claim 1, wherein each wheel member includes a binary coded disc having binary coded means on the periphery thereof for intercepting the light beam in accordance with the rotative position of the disc.

3. In a device for recording and accumulating events, the improvement comprising:

a frame;

a plurality of wheel members representing respective columns of the decimal number system, one wheel member being adapted to be driven in relation to the occurrence of the events that are to be recorded and accumulated;

means mounting said wheel members for rotation on said frame, in a series arrangement;

means coupling said wheel members together in a manner to effect rotation of each pair of adjacent wheel members in a ratio of one to ten;

a set of rigidly connected discs arranged in a series in each wheel member and representing respective columns of the binary number system, said discs cooperating to present binary coded peripheral regions on each wheel member which provide an optically detectable indication of the rotative position of the wheel member with respect to a reference position; and optical means cooperable with the peripheral regions of said wheel members to optically detect the rotative position of each wheel member with respect to the reference position.

4. The improvement set forth in claim 3, wherein said optical means includes:

a light source operable to emit a beam of light;

means mounting said light source on said frame for movement along a preselected scanning path wherein the light beam serially scans the peripheral region of each wheel member;

means for effecting movement of said light source along said scanning path; and a light sensor located in the path of the light beam with the peripheral regions of said wheel members located between said source and sensor as said source moves along its scanning path, said sensor being operable to detect changes in the light beam effected by the peripheral regions of said wheel members as said source moves along its scanning path.

* * * * *